United States Patent [19]

Flum

[11] 4,454,949

[45] Jun. 19, 1984

[54] PRODUCT MERCHANDISING DISPLAY UNIT

[75] Inventor: Paul Flum, University City, Mo.

[73] Assignee: Paul Flum Ideas, Inc., St. Louis, Mo.

[21] Appl. No.: 369,102

[22] Filed: Apr. 16, 1982

[51] Int. Cl.[3] ..... A47F 7/16

[52] U.S. Cl. ..... 211/49 D; 211/126; 206/563; 206/564

[58] Field of Search ..... 211/49 D, 153, 128, 211/72, 126; 206/561, 564, 562, 563; 220/8; 248/221.2

[56] References Cited

U.S. PATENT DOCUMENTS

| | | | |
|---|---|---|---|
| Re. 30,706 | 8/1981 | Bustos | 211/49 D |
| 1,389,973 | 9/1921 | O'Conner | 211/49 D |
| 3,203,553 | 8/1965 | Pendergrast, Jr. et al. | 211/49 |
| 3,203,554 | 8/1965 | Pendergrast, Jr. et al. | 211/49 |
| 3,900,112 | 8/1975 | Azzi et al. | 211/148 |
| 3,927,769 | 12/1975 | Maslow et al. | 211/153 |
| 4,293,062 | 10/1981 | Bustos | 193/2 D |
| 4,294,363 | 10/1981 | Oztekin et al. | 211/49 D |
| 4,310,097 | 1/1982 | Merl | 211/49 D |
| 4,314,648 | 2/1982 | Spamer | 211/49 D |

FOREIGN PATENT DOCUMENTS

| | | | |
|---|---|---|---|
| 43097 | 10/1970 | Finland | 211/49 D |
| 2032886 | 5/1980 | United Kingdom | 206/564 |

OTHER PUBLICATIONS

Copending Patent application Ser. No. 262,117 entitled Product Merchandising Rack Filed by Applicant on Apr. 11, 1981, Group Art Unit 355.

*Primary Examiner*—William H. Schultz

*Assistant Examiner*—Blair M. Johnson

*Attorney, Agent, or Firm*—Haverstock, Garrett & Roberts

[57] ABSTRACT

A product display and merchandising device adaptable to be supported on a supporting surface comprising a unitary base member having front, rear, and opposed side walls and an inclined floor portion extending therebetween, the floor portion including a plurality of upstanding wall portions forming a plurality of guide channels, a plurality of spaced track members removably attachable to the floor portion and positioned within the guide channels for supporting products positioned thereon, the guide channels extending between the front and rear walls for maintaining and guiding products positioned on the track members in parallel rows therebetween, the floor portion being supported in an inclined position by the front, rear, and side walls whereby rows of products positioned within the guide channels will slide along the guide channels on the respective track members towards the front wall to maintain the products in each respective guide channel adjacent the front wall, the floor portion also including wall portions forming at least one cavity positioned within each respective guide channel to define a space adjacent to the respective track member which spaces extend beyond at least one side of the respective track members, at least one aperture through the wall portions forming each cavity for allowing air to enter the cavities to circulate therethrough and around the rows of products positioned on the track members. The present device may also include an optional apertured plate member attached to the underside portion of the base member.

17 Claims, 9 Drawing Figures

PRODUCT MERCHANDISING DISPLAY UNIT

The present invention relates to a product display device for use in storing and merchandising shelved products and, more particularly, to an improved shelving structure adaptable for holding and dispensing products and having a plurality of parallel inclined guide channels defined therein such that when products are placed therein, such products will automatically slide along removable attachable track members disposed within each respective guide channel towards the front lower portion of the shelving structure thereby continuously maintaining the products positioned therein adjacent the front wall for easy access by the customer. The present shelving structure is primarily designed for use in refrigerated display cases and includes means whereby refrigerated air may be circulated around and between the rows of products positioned thereon. The present device can likewise be conveniently utilized as a shelf conversion system for existing shelf structures commonly used in supermarkets and other food and beverage outlets as well as being adaptable for use in a multiplicity of other display rack applications.

A wide variety of display devices including modular display fixtures have been designed and manufactured for use in merchandising shelved products to consumers. These display devices are commonly employed by supermarkets and other retail stores for use in store display windows and other display areas to show and focus attention on the wares displayed therein. One of the major problems associated with storing and displaying shelved products for sale to customers, and in particular, shelved products requiring refrigeration in display coolers and other types of cold vaults, is the inefficient use of available shelf space and the inability of the merchant to continuously provide shelved products which are readily accessible to the customer at the front portion of the shelf. Typically, articles of merchandise, especially products such as numerous bottled and canned goods, are randomly distributed and stacked in segregated areas on a shelf or other display unit in such a manner that the selection of a particular goods item, access to that particular item, and the removability of that item from the shelf or display unit by the customer becomes, at times, difficult if not impossible. In an effort to overcome poor utilization of shelf space, various gravity feed type shelving displays have been designed whereby products positioned thereon are automatically moved towards the front portion of the shelving structure so as to be readily accessible and easily visible to the customer. Such gravity feed type shelving displays are for the most part characterized by complicated and cumbersome constructions which include multiple component parts and complicated support frame structures. See for examples the constructions shown in U.S. Pat. Nos. 4,310,097; 4,294,363; 3,900,112; 3,499,539; 3,203,553; and 3,203,554. Other known constructions utilize intricate and complicated means such as conveyor belts, rollers and the like for achieving the gravity feed characteristics associated therewith. See for examples the constructions shown in U.S. Pat. Nos. 4,293,062 and Re. 30,706. All such prior art devices suffer from certain disadvantages and shortcomings including being relatively large, bulky, awkward, and difficult, if not impossible, to use on shelf space presently available in supermarkets and other retail outlets, including the shelf space available in conventional refrigerated display coolers. In addition, none of the known devices or methods for storing and merchandising shelved products are as simple structurally as the present construction and none utilize as efficient and effective means for both improving the slidability of products positioned thereon and allowing air to circulate around and between the products positioned thereon which is especially important when the shelved products require refrigeration. For these and other reasons, most known gravity feed type product display devices have enjoyed limited usefulness.

The present product merchandising device overcomes many of the disadvantages and shortcomings associated with known display devices, and teaches the construction and operation of a relatively simple gravity feed type shelving device which includes a base member preferably of a one-piece molded plastic construction having opposed front and rear walls and a downwardly and forwardly inclined floor portion extending therebetween. The unitary base member also includes a plurality of parallel guide members extending between the front and rear wall portions defining a plurality of parallel adjacent guide channels for guiding products positioned therein in parallel rows. A track member is removably attachable to the floor portion of the base member in each guide channel and likewise extends between the front and rear wall portions forming a sloping support bottom in each channel for supporting products positioned thereon. The floor portion of the subject device forms an inclined plane whereby rows of products positioned on the device will automatically slide along the track members towards the front wall so as to continuously maintain such products adjacent the front wall for easy access to the customer. The track members are specifically constructed to accommodate and support any and all products positioned thereon regardless of the shape of their bottom wall surface and likewise include means for improving the slidability of products positioned thereon. In addition, the front wall portion of the base member is shaped to form a plurality of inverted arches, each of which is positioned respectively adjacent the front edge portion of the respective guide channels and each serves as a forward stop means for holding and retaining products positioned within the respective channels until such products are removed therefrom. The arches in the front wall expose more of the products to view and also facilitate the customer reaching into the channels to better grip a product being removed.

The present display device further includes means forming a plurality of cavities or pockets formed within the base structure and positioned in longitudinal alignment and in communication with the respective guide channels. These cavities are disposed below the removably insertable track members and each includes a plurality of aperatures and vents which allow refrigerated air to circulate therethrough and around and between the rows of products positioned on the track members. This means for venting refrigerated air through the base member and around the products makes the subject device particularly advantageous for use in refrigerated display coolers and other types of cold vaults commonly found in supermarkets, convenience stores, grocery outlets, drug and liquor stores, fast food outlets, and a wide variety of other wholesale and retail stores. Because of these capabilities, the present device provides simple and efficient means for effectively utilizing shelf space; it provides for the orderly and attractive arrangement and display of products; it provides a gravity feed system whereby shelved products are always maintained at the front portion of the display rack where they are easily accessible; and it provides an effective means for enabling the circulation of refrigerated air around and between the rows of products positioned thereon when used in a refrigerated display cooler. These features are particularly important to merchants because they increase the accessibility to the customer of products being displayed therein and they more effectively and attractively utilize available shelf space. Although it is anticipated that the present shelving structure will be utilized primarily in refrigerated display coolers, the present device is likewise adaptable for use in other display rack applications and can likewise also be utilized to transform non-refrigerated shelves in retail stores to gravity feed merchandising shelves or systems.

It is therefore a principle object of the present invention to provide an efficient and attractive product display unit adaptable for storing and merchandising a wide variety of shelved products.

Another object is to provide a product merchandising display unit that is structurally and operationally relatively simple and inexpensive to make.

Another object is to provide a product merchandising display unit having means associated therewith for continuously maintaining some of the products positioned therein adjacent the front portion thereof for easy accessibility to the customer.

Another object is to provide a product merchandising display unit having means associated therewith for enabling effective circulation of refrigerated air around and between the products positioned thereon.

Another object is to provide a product merchandising display unit which more effectively utilizes available shelf space and other merchandising areas, including shelf space associated with refrigerated display coolers.

Another object is to provide an attractive gravity feed support means which exposes a greater portion of the products being dispensed to customer view.

Another object is to provide a product merchandising display unit which attractively organizes the products positioned therein in convenient parallel rows for easy access and removal.

Another object is to provide a product merchandising display unit which includes replaceable track means capable of slideably supporting a wide variety of shelved products.

Another object is to teach the construction of a product merchandising display unit which can be easily and safely accessed by the customer for product selection and product removal.

Another object is to teach the construction of a product merchandising display unit which can be easily and quickly refilled from either the front or rear.

Another object is to provide a shelving display construction which is lightweight, durable, easy to install and able to withstand moderate impact and mishandling without breakage.

Another object is to provide an improved product merchandising display unit adaptable for use with existing shelf systems commonly utilized in supermarkets and other merchandising centers, including shelf systems associated with refrigerated display coolers.

Another object is to provide an inclined product merchandising display unit which includes means for improving the slidability of products positioned thereon.

Another object is to provide product merchandising display units which are nestable one on top of the other for ease of storage, packaging and transportation.

These and other objects and advantages of the present invention will become apparent to those skilled in the art after considering the following detailed specification of a preferred embodiment of the subject device in conjunction with the accompanying drawings wherein.

Figure 1:
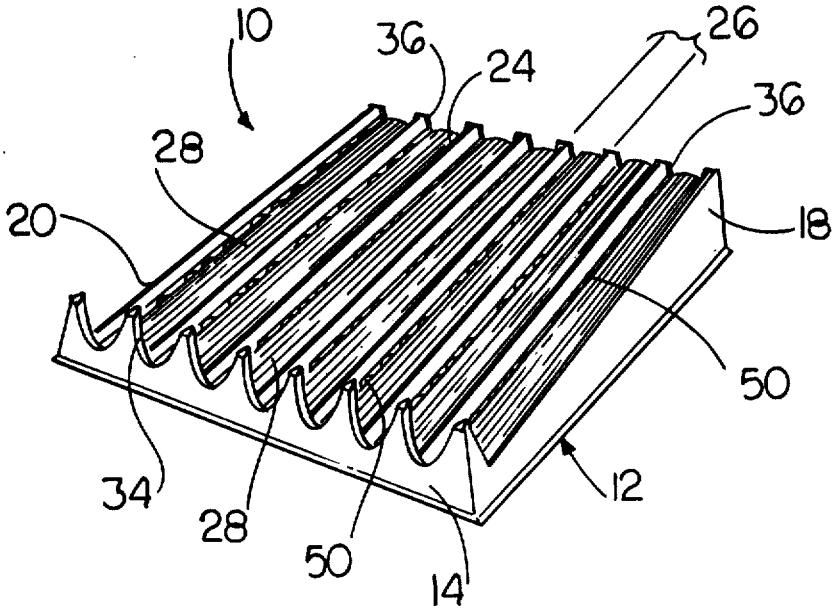
FIG. 1 is a perspective view of a product display device constructed according to the teachings of the present invention.

Referring to the drawings more particularly by reference numbers wherein like numerals refer to like parts, number 10 in FIG. 1 identifies a product merchandising display unit constructed according to the teachings of the present invention. The shelving display device 10 is specifically designed for merchandising products such as bottled and canned soft drink products and the like, and comprises a generally one-piece rectangular structure 12 adaptable for use on a support structure such as on shelving commonly employed by supermarkets and in a wide variety of other food and beverage outlets, including shelving associated with conventional refrigerated display coolers and cases and other types of cold vaults commonly utilized for storing and merchandising a wide variety of products. The member 12 includes spaced front and rear walls 14 and 16, spaced side walls 18 and 20, and an upper floor 22 which extends substantially the full length and width of the device between the front, rear, and side walls as shown in FIGS. 1–5. The walls 14, 16, 18 and 20 support the floor 22 in an elevated inclined position sloping from a more elevated position at the rear of the device to a less elevated position at the front such that when the device 10 is resting on a horizontal surface objects placed thereon will slide toward the front wall as will be explained.

Figure 3:
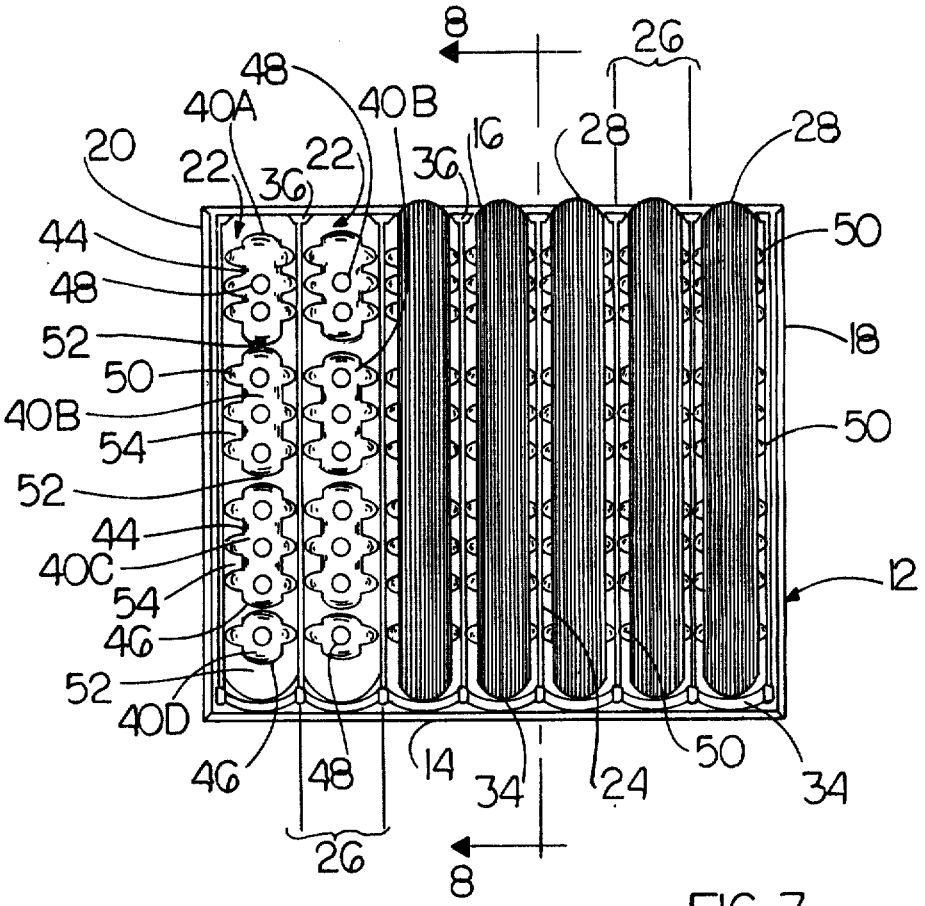
FIG. 3 is a top plan view of the shelving device of FIG. 1 showing several of the track members removed therefrom.
Figure 6:
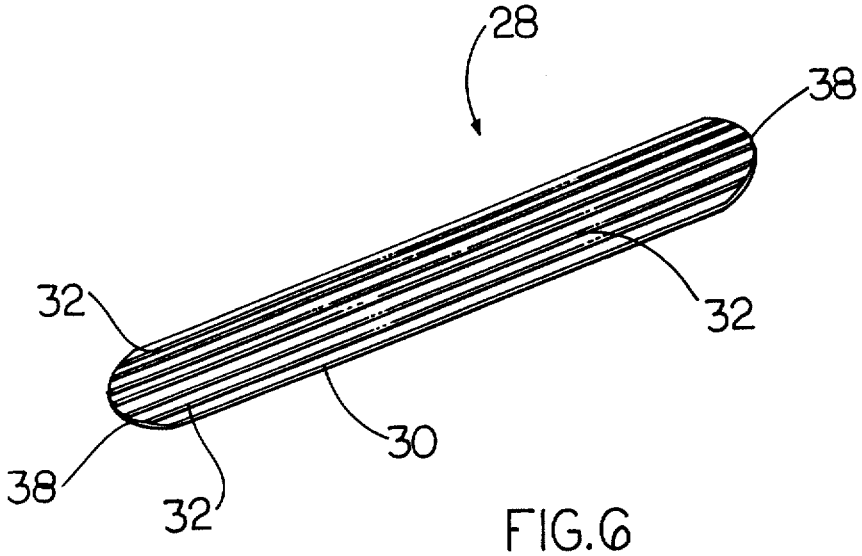
FIG. 6 is a perspective view of one of the removable track members for use on the subject device.

The structure 12 also includes a plurality of spaced upstanding wall portions or partitions 24 that extend between the front and rear walls 14 and 16 defining therebetween a plurality of parallel guide channels 26 for supporting and guiding products positioned therebetween in parallel rows. Each of the guide channels 26 is defined in part by a portion of the floor 22 as shown in FIG. 3. It is preferred that the wall portions 24 be integrally formed with the base structure 12 to simplify the construction and to lend strength and stability to the device 10, although any suitable means could be used for attaching the members as desired. Track members 28 as shown in FIG. 6 are positioned in each of the respective guide channels 26 and likewise extend between the front and rear walls 14 and 16. The track members 28 are preferably adhesively attached to the floor 22 of the base structure 12 and form the support surfaces on which merchandise rests and slides. The track members 28 are constructed so as to be easily installed, removed and replaced with a minimum of cost and trouble as will be explained. The ease with which the track members 28 can be installed, removed and replaced greatly facilitates maintenance of the device and without having to repair and/or replace the entire device 10.

The inclination of the floor 22 is such that when rows of products are positioned within the respective guide channels 26 and supported on the track members 28 they will slide under the force of gravity towards the front end portion of the shelf 10. This is important because it not only provides for the orderly and attractive arrangement and display of the products, but it also provides a gravity feed system whereby the remaining products in each row are always moved to the front of the device for easy access and removal by the customer. As explained in applicant's U.S. Pat. No. 4,416,380, it has been found that a track inclination or slope of between about 7° to 8° provides a desirable condition such that when the up-front product in one of the rows is removed, the remaining products positioned therebehind will automatically slide along the respective track members 28 in a steady manner and without toppling over. Although tests demonstrate that an inclination or slope of between of about 7° to 8° is preferred, slopes in a range from about 3° to 10° have been tested and found to also provide suitable results for some applications depending upon the particular display unit, the nature of the goods being merchandized and the material from which the tracks are made.

Each of the track members 28 includes a substantially flat base portion 30 with a plurality of spaced longitudinally extending ribs or runners 32 extending upwardly therefrom, as shown in FIG. 6. The track members 28 are made to be substantially the same length as the floor portions 22 and should be of a width less than the width of the floor portions 22 so as to be easily insertable into the channels 26 and to provide uncovered floor spaces along the floor portions on opposite sides thereof as will be shown. It is important that the spacing between the runners 32 be selected to accommodate and support any and all of the various products that are to be positioned thereon regardless of the shape or contour of their bottom walls. Since many articles of merchandise are packaged in containers having unique and unusual shapes including unusual shapes or contours for their bottom surfaces, it is usually preferred to have the spacing between the runners 32 substantially uniform and relatively small across the tracks 28 so as to accommodate and support products having many different bottom wall configurations. The specific spacing selected may be especially important for some products that have contoured bottoms to properly support the products on the tracks 28 to reduce the possibility that they will overturn. The track members 28 are preferably of unitary construction and can be extruded or molded from a plastic material such as from hi-impact polystyrene, polycarbonates, various nylons, rigid vinyl compositions, or polyesters. Various impact polystyrenes are particularly suitable for the practice of this invention. Generally, the impact polystyrene will be made using a relatively high percentage of polystyrene and a lower percentage of a rubber modifier. The use of the runners 32 is generally preferred over use of a member that has a flat upper surface because the runners 32 reduce friction between the track members and the products positioned thereon thereby improving the slidability of the products therealong.

The materials used for the track members 28 are also preferably mixed with or impregnated with about 0.5% to 5% silicone to further improve the slidability of products positioned thereon. As explained in Applicant's U.S. Pat. No. 4,416,380 the impact polystyrene used in forming the track members 28 is preferably mixed with a minor percentage by weight of a silicone resin. The preferred silicone resins are those which mix most easily with the impact polystyrene and are characterized by being non-oxidizing, non-corrosive, non-toxic and add lubricating properties to the impact polystyrene which is most useful in the practice of this invention. While between about 0.5% to 5% silicone in the members 28 is desirable, greater or lesser amounts of silicone can be used depending on the desired slidability. The combination of polystyrene and silicone produces track members with runners that have relatively smooth slick surfaces exhibiting self-lubricating characteristics which, when attached to the inclined floors 22, enable shelved products positioned thereon to move easily and smoothly therealong. A particularly suitable silicone resin material for this purpose is Dow-Corning 200 silicone fluid additive which is comprised of a clear dimethly siloxane having a viscosity of 0.65 to 5 million c.s. It should be noted that the silicone material is generally added in a minor proportion to the impact polystyrene or other plastic substance and may be present in amounts up to about 10% by weight, although about 0.5% to 5% is generally preferred, as stated. A particularly useful combination of ingredients includes 2.5% by weight of Dow-Corning 200 silicone fluid additive and 97.5% by weight of styrene-butadiene modified polystyrene resin. Although not required with the present invention, the impregnation of silicone into the plastic substance used to make the track members 28 substantially reduces the possibility that products stored thereon will jam or stick and not slide and it greatly enhances the reliability and the effectiveness of a gravity feed system employing the tracks 28.

Figure 2:
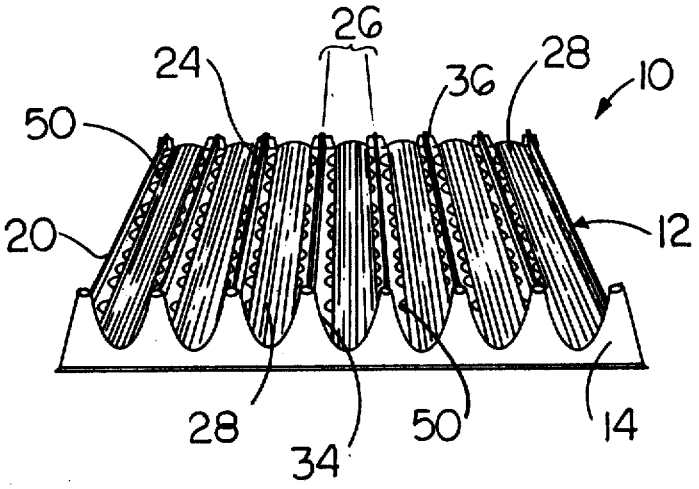
FIG. 2 is a front perspective view of the shelving device of FIG. 1.
Figure 5:
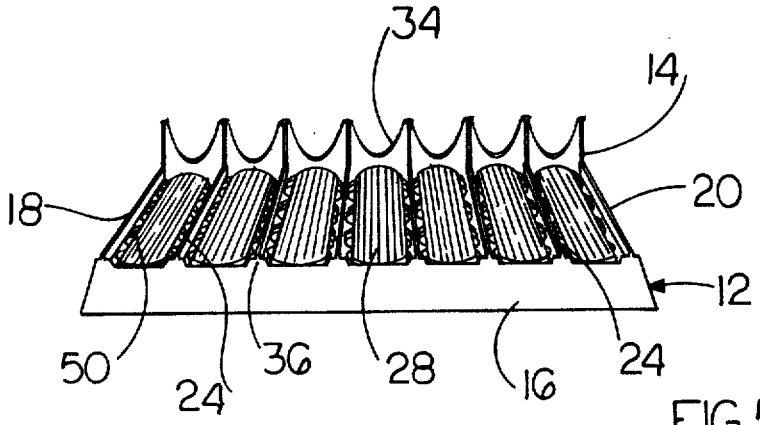
FIG. 5 is a rear perspective view of the same shelving device.

It should be noted that the front wall 14 of the base structure 12 is formed to include a plurality of inverted arches 34 as clearly shown in FIGS. 1, 2 and 5. The inverted arches 34 are uniformly disposed across the length of the front wall 14 and are positioned respectively adjacent to the front end of each respective guide channel 26. Besides enhancing the aesthetic appearance of the display unit 10, the arches 34 serve as stop means for holding and retaining products positioned within the respective channels 26 until such products are removed therefrom. The arches 34 also, and importantly, expose a large area of the products still in the device and the arches also facilitate the customer reaching with his or her hand into the device to take hold ofandremove a product. In this latter regard, it is also highly preferred to have the edges of the arches 34 rounded so that they will be smooth against the customer's hand and not rub or cause injury.

Stop means in the form of upstanding flanges 36 are positioned respectively at the rear corners of each channel 26 adjacent the rear ends of the wall portions or partitions 24. The flanges 36 are provided to make it easy to locate the tracks 28 centrally longitudinally on the floor portions 22 and also help to hold and retain products within the respective guide channels 26. The flanges 36 extend laterally from the guide members 24 and are preferably formed integrally with the members 24 and with the rear wall 16.

Both opposite ends 38 of the track members 28 are preferably rounded or curved as shown in FIG. 6 so as to more easily accommodate and register with the rounded front edge portion of each guide channel 26 as best shown in FIG. 3. The width of the members 28 is also such that when one end of said members abuts the rounded front end of the respective channels 26, the opposite end will abut the spaced flanges 36 on opposite sides of the rear end of the respective channels 26 to center the track members 28 laterally in the respective floor portions 22. Since both opposite ends 38 of the track members 28 are configured in the same manner, the track members 28 can be inserted into the respective channels 26 facing in either direction. This is advantageous because it means that when the track members 28 are removed for cleaning, replacement and/or for other means, they can be easily, quickly, and properly reinstalled without worrying about the end to end orientation.

Figure 4:
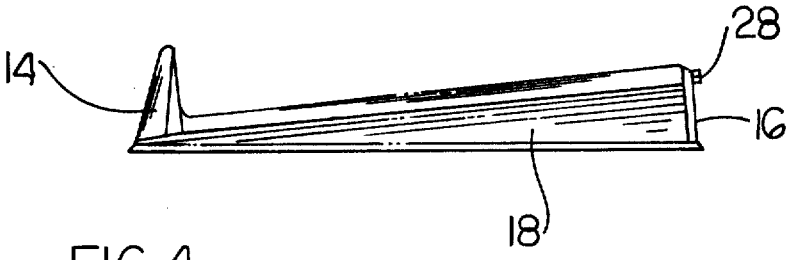
FIG. 4 is a side elevational view of the shelving device of FIGS. 1–3.

In addition to displaying products in an attractive yet readily accessible manner, the present product merchandising display unit 10 effectively utilizes the available shelf space and allows the merchant to easily fill and refill the device either from the front or the back thereof. The ability to load the device from the front or from the rear is an advantage in some situations. Since the rear of the subject device is elevated and largely open sided, access to the channels 26 from the rear is less restricted than known devices which have upstanding rails and walls which make them more difficult to fill especially from the rear. The same is also true of the front of the device. Additionally, in the present construction the rear portions of the track members 28, because of their rounded shape, may extend slightly beyond the rear wall 16 as shown in FIG. 4 to further facilitate the ease with which the present device can be loaded from the rear.

Figure 7:
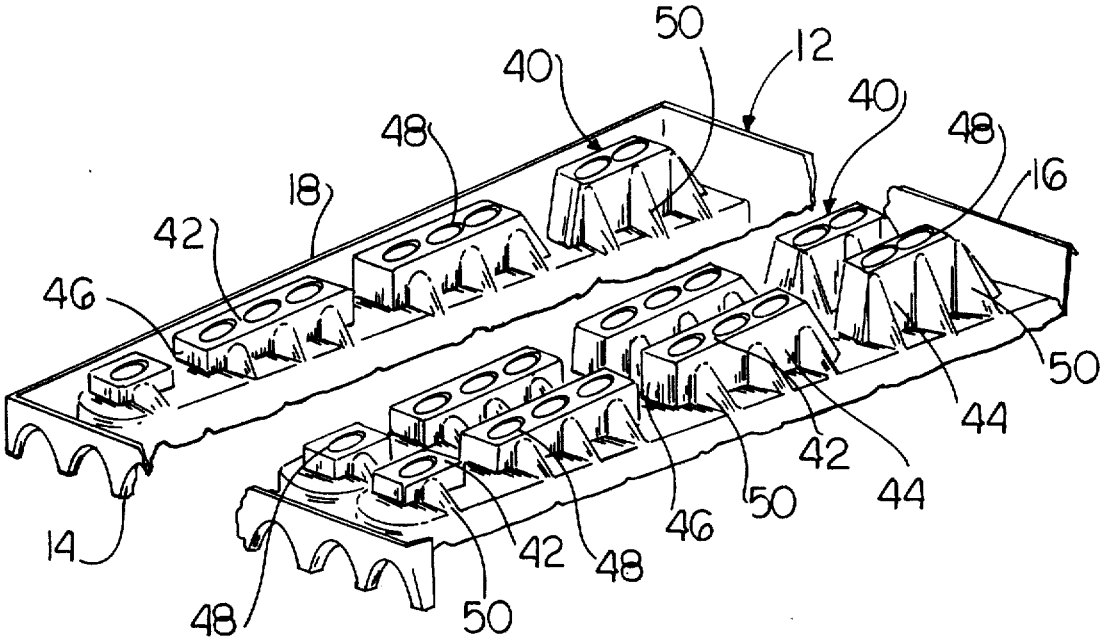
FIG. 7 is an enlarged fragmentary perspective view of the bottom of the subject device detailing the structure of the cavities formed within the base structure.
Figure 8:
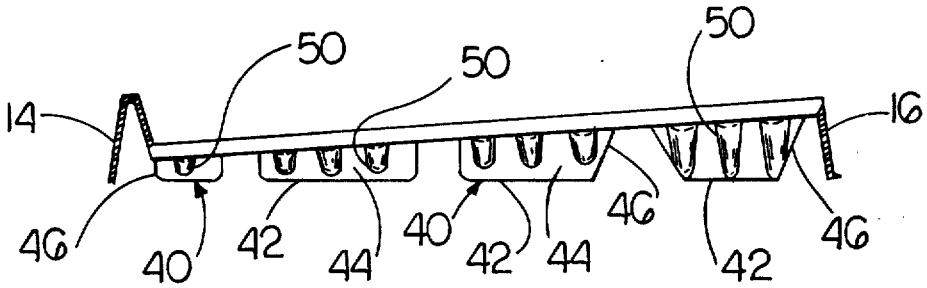
FIG. 8 is a cross-sectional view taken along line 8—8 in FIG. 3.

The construction of the present shelving device 10 also is such as to facilitate the circulation of air including refrigerated air through the device and around the products thereon when installed in a refrigerated display case. This enables the present devices to be effectively utilized in refrigerated display coolers as well as in other environments thus increasing their usefulness. To achieve this, the devices 10 are formed with a plurality of integral downwardly extending cavities or pockets 40 which extend downwardly from the surface 22 in each channel 26 as shown in FIGS. 3, 7 and 8. These cavities such as the cavities 40A, 40B, 40C, and 40D are positioned in longitudinal alignment in each respective guide channel 26 as shown in FIG. 3, and the cavities 40A–40D are beneath the track members 28 when the track members are positioned in their respective guide channels 26 as explained above, and each cavity defines a space below the respective track member. The cavities 40A–40D are shown as being substantially rectangular in shape and each includes a bottom wall 42, opposed side walls 44, and opposed end walls 46 (FIGS. 7 and 8). Each cavity 40A–40D likewise has at least one, and in some cases two or three, apertures 48 through their bottom wall 42 which apertures allow air to pass therethrough.

Each of the cavities or pockets 40A–40D also has sidewardly extending portions such as cavity portions 50 in FIG. 3. The portions 50 extend sidewardly far enough so that when the tracks 28 are positioned in the channels 26 there will be some communication between the pockets such as the pockets 40A–40D and the space above the device 10. This is done to facilitate air circulation through the device and around the products positioned thereon. Like the apertures 48, the greater the number and size of the portions 50 the better will be the air circulating characteristics.

Referring to FIGS. 7 and 8, it should be noted that the side walls 44 of the cavities 40 are dimensioned to achieve a proper inclination or slope of the floor 22 and to align the bottom cavity walls 42 with the free edges of the side walls 18 and 20. It is likewise important to note that when the device 10 is positioned on a supporting structure such as on a conventional shelf, the bottom wall 42 of each respective cavity 40 is flush with the supporting structure. This means that the walls of the cavities 40 add substantially to the overall strength of the device and to its load carrying capacity. It is to be understood, however, that the particular shapes and number of the cavities 40A–40D can be varied considerably without departing from the present invention. In this regard, it is to be noted that the end walls 46 associated with some of the cavities such as cavities 40A and 40D are somewhat modified from the others to further improve the air circulation characteristics.

As discussed above, the track members 28 are preferably removably attachable to the floor portions 22, and each respective guide channel 26 includes transverse portions 52 that extend between the adjacent cavities such as the cavities 40A–40D shown in FIG. 3 to provide added support therefor. Some support for the members 28 is also provided by floor portions 54 which are between adjacent ones of the cavity portions 50. It is anticipated that many suitable attachment means may be utilized to secure the track members 28 to the floor 22, and the attachment means should prevent relative movement and looseness between the track members 28 and the floor 22. Certain types of non-drying and slow-drying glues and other known adhesives are suitable and provide a simple, quick and efficient means for removably attaching the members 28.

Figure 9:
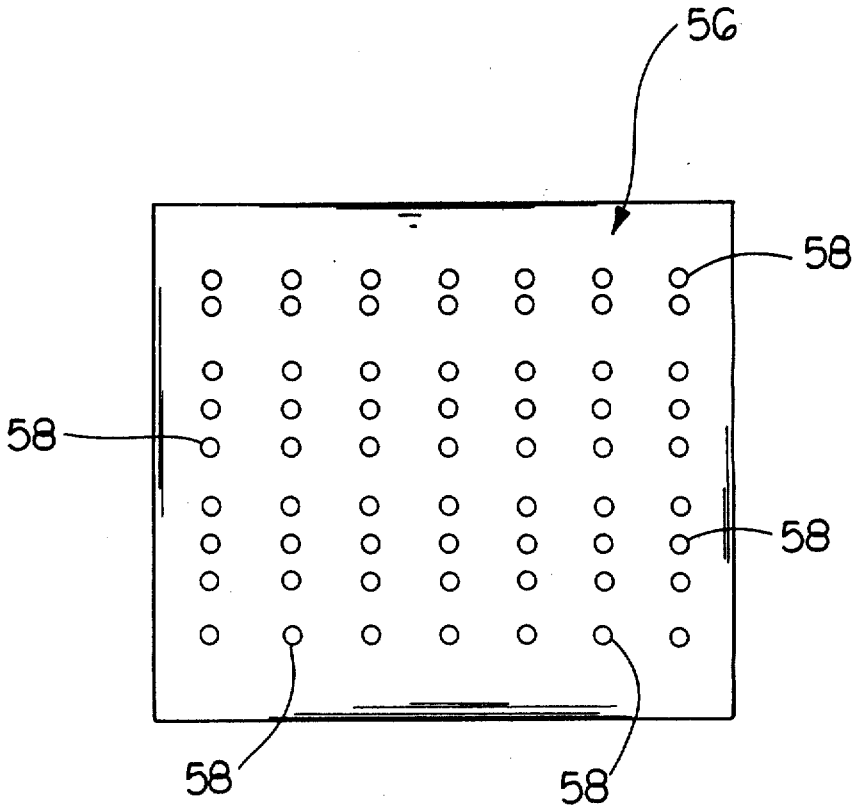
FIG. 9 is a plan view of an optional base plate for attaching to the underside portion of the subject devices.

An optional base plate 56 having a plurality of shaped apertures 58 therethrough as shown in FIG. 9 may be attached to the underside portion of the structure 12 by suitable means including adhesive means. The apertures 58 are of a size and are arranged in parallel rows and columns to register with the apertures 48 in the cavities 40A–40D. When the plate 56 is attached to the underside of the structure 12, the plurality of registered apertures 48 and 58 allow air to circulate through the device as aforesaid. Although the apertures 48 and 58 are depicted as being round holes of equal diameter, it is recognized that varying sizes and shapes of the apertures 48 can be used including apertures that are elliptical, oval, square, diamond shaped or the like. It is also recognized that the size of the apertures 48 may vary from cavity to cavity within the same device. Regardless of the size and shape of the apertures 48 and 58, it is important that they be arranged to register when a plate such as the plate 56 is used. Although the base plate 56 is optional and is not required in the practice of the invention, when it is used, it adds rigidity and stability to the device 10 and it also enhances the appearance of the device and facilitates its use by making it easier to slide onto or off of a supporting structure such as the supporting grid structure of a shelf.

Although it is recognized that various acceptable materials of construction are available and could equally be employed to construct the present device, it is usually preferred that the device 10 be constructed from a relatively rigid plastic material able to withstand moderate impact and mishandling without breakage. Through the use of a suitable mold, the entire base structure 12 can be vacuum formed into a unitary construction from a single sheet of plastic material. The shape and contour of the structure provides it with substantial structural integrity. It is also recognized that certain metals, metal alloys, fiberglass or even wood or other materials could be utilized in the practice of this invention but plastics have been found to be preferred. The selection of the material should take into account the type of products and their containers to be merchandised therefrom and the environment where the device is to be located. Additionally, the overall length and width of the device can be varied to accommodate different shelf and product sizes and shapes without departing from the teachings and practice of the invention. Likewise, any number of similar shelving devices may be arranged and/or connected adjacent to each other as required, thus increasing the usefulness and effectiveness of the device. Furthermore, signage and other indicia may be applied to the front and/or rear wall portions of the device for attractively advertising the particular goods items being sold and to aid the merchant when restocking the shelves. The present devices, when used without the optional base plate 56, are also stackable and nestable one on top of the other for ease of storage, packaging and transportation. When nested one upon the other, the devices take up very little space, a feature highly desirable for merchants and others who may have to store the subject devices in crowded storerooms and other places.

Thus there has been shown and described a novel product merchandising display unit for use in storing and merchandising shelved products, including products requiring refrigeration, which display unit fulfills all of the objects and advantages sought therefor. Many changes, modifications, variations, and other uses and applications of the present construction will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A product display and merchandising device adaptable to be supported on a support structure comprising a base member having front, rear and opposed side wall portions and a floor portion extending therebetween, said floor portion being defined by a plurality of spaced channel portions extending between the front and rear wall portions and a plurality of upstanding wall portions positioned therebetween, a track member positioned extending along each of said channel portions for supporting products positioned thereon, said upstanding wall portions extending between said front and rear wall portions for guiding and maintaining products positioned on said track members in parallel rows therebetween, said floor portion being supported in an inclined position when said device is supported on a horizontal surface such that rows of products positioned between said upstanding wall portions will slide along the respective track members positioned therebetween towards the front wall portion, wall means in each of said channel portions extending downwardly from said floor portion forming at least one cavity therein, each of said cavities defining a space adjacent to the respective track member positioned within said respective channel portions, opening means formed in each of said cavity forming wall means for allowing air to enter said cavities, each of said track members being dimensioned such that uncovered cavity spaces extend along opposite sides thereof when said track members are positioned within said channel portions, said uncovered cavity spaces communicating the space within each of said cavities with the space above said floor portion for allowing air to circulate therethrough and around the products position on said track members, said cavity forming wall means and the front, rear, and opposed side wall portions of said base member being dimensioned to achieve the proper inclination of said floor portion.

2. The product display device defined in claim 1 wherein each of said track members is removably attachable to each of said spaced channel portions.

3. The product display device defined in claim 1 including stop means on said front wall portion to limit forward movement of the products positioned within each of said channel portions.

4. The product display device defined in claim 1 including a plurality of spaced cavity forming wall means formed in each of said channel portions.

5. The product display device defined in claim 3 wherein said stop means includes a plurality of inverted arches uniformly disposed across said front wall portion, each of said inverted arches being positioned respectively adjacent to the front end of each of said channel portions.

6. The product display device defined in claim 1 wherein said floor portion is inclined in operative position at an angle to the horizontal between about 3° and about 10°.

7. A product display and merchandising device adaptable to be supported on a support structure comprising a member having front, rear, and opposed side wall portions and floor means extending therebetween, said floor means including guide means extending between said front and rear wall portions defining a plurality of parallel guide channels therebetween, a plurality of spaced track members attachable to said floor means and extending between said front and rear wall portions for supporting products positioned thereon, one of said track members being positioned within each of said guide channels to form the bottom wall thereof, said floor means being supported in an inclined position when said device is supported on a horizontal surface such that products positioned within said guide channels will slide along said track members towards the front wall portion to maintain the front product in each of said guide channels adjacent to said front wall portion, said front wall portion including stop means to limit forward movement of the products positioned within each of said guide channels, wall means extending downwardly from said floor means positioned within each respective guide channel forming a plurality of cavities therein, each of said cavities defining a space below the respective track member positioned on said floor means, at least one aperture through the wall means forming each cavity for allowing air to enter said cavities, said cavities being shaped and dimensioned such that portions thereof are narrower than the track members positioned thereabove and other portions are wider than said track members, said other cavity portions forming at least one passageway on each opposite side of said track members for communicating the space within each of said cavities with the space above said floor means for allowing air to pass through said floor means for circulation around the products positioned on said track members, said cavity forming wall means and said front, rear and side wall portions providing the proper inclination and support for said floor means when said device is positioned on a supporting surface.

8. The product display device defined in claim 7 including a plate member attached to said device, said plate member having a plurality of apertures therethrough positioned to register respectively with the apertures associated with each of said cavities.

9. The product display device defined in claims 1 or 7 wherein each of said track members include an elongated member having a substantially flat base portion with a plurality of longitudinal runners extending outwardly from one side thereof, said runners extending in parallel relation in position to support and guide the movement of products positioned thereon.

10. The product display device defined in claim 7 wherein said floor means is inclined in operative position at an angle to the horizontal between about 3° and about 10°.

11. A shelving device to be supported on a supporting surface for storing and merchandising shelved products comprising a base member having spaced front, rear, and opposed side walls and a floor member extending therebetween, a plurality of track members positioned on said floor member and extending between said front and rear walls for supporting products positioned thereon, said floor member including a plurality of guide channels extending between said front and rear walls for guiding products positioned on said track members in parallel rows therebetween, each of said guide channels being positioned such that a respective track member forms the bottom wall thereof, said floor member including a plurality of cavities positioned within each respective guide channel, said cavities each including side wall portions extending downwardly from said floor member and a bottom wall portion extending therebetween, each of said cavities defining a space below the respective track member positioned on said floor member, the bottom wall portion of each of said cavities having at least one aperture therethrough for allowing air to enter said cavities, each of said cavities including a plurality of sidewardly extending cavity portions, each of said plurality of cavity portions extending sidewardly far enough such that when said track members are positioned within their respective guide channels there will be communication between the space within each of said cavities and the space above said floor member for enabling air to circulate through said floor member and around the products positioned on said track members, said floor member being supported in an inclined position when said device is supported on a horizontal surface, the side wall portions of said cavities and the opposed side wall portions of said base member being dimensioned to achieve the proper inclination of said floor member, the bottom wall portion of said cavities being in alignment with the face edges of the opposed side wall portions of said base member.

12. The shelving device defined in claim 11 wherein said floor member is inclined in operative position at an angle to the horizontal between about 3° and about 10°.

13. The shelving device defined in claim 11 including a plate member attached to the underside portion of said base member, said plate member having a plurality of apertures therethrough positioned to register respectively with the apertures associated with said plurality of cavities.

14. The shelving device defined in claim 11 wherein said front wall includes a plurality of inverted arches positioned respectively adjacent to the front end of each of said guide channels.

15. A shelving device to be supported on a supporting surface for storing and merchandising shelved products comprising a member having spaced front, rear, and opposed side walls and a floor member extending therebetween, a plurality of track members positioned on said floor member and extending between said front and rear walls for supporting products positioned thereon, said floor member including a plurality of guide channels extending between said front and rear walls for guiding products positioned therein and a plurality of wall dividers positioned therebetween, each of said guide channels being positioned such that a respective track member forms the bottom wall thereof, said floor member being supported in an inclined position when said device is supported on a horizontal surface whereby rows of products positioned in each of said guide channels will slide along their respective track members positioned therebetween towards the front wall, said floor member including wall means extending downwardly therefrom forming at least one cavity positioned within each respective guide channel, each of said cavities defining a space adjacent to the respective track member positioned on said floor member, each of said track members being narrower than at least a portion of said cavity spaces and each being located within a respective guide channel and atop said cavity spaces such that at least one uncovered cavity space associated with each respective cavity is formed between one side thereof and the adjacent wall divider, at least one aperture through the wall means forming each cavity for allowing air to enter the space defined by said cavities, said cavity forming wall means and said front, rear and side walls being dimensioned to achieve the proper inclination of said floor member, said uncovered cavity spaces communicating the space within each of said cavities with the space above said floor member for allowing air to circulate therethrough and around the products positioned on said track members.

16. The product display device defined in claim 1 wherein said cavity forming wall means include side wall portions and a bottom wall portion extending therebetween, said cavity side wall portions being dimensioned such that the cavity bottom wall portions are in alignment with the free edges of the opposed side wall portions of said base member.

17. The shelving device defined in claim 15 wherein said cavity forming wall means include side wall portions and a bottom wall portion extending therebetween, said cavity side wall portions being dimensioned such that the cavity bottom wall portions are in alignment with the free edges of the opposed side walls of said shelving member.

* * * * *